US009549591B2

(12) United States Patent
Uchikawa et al.

(10) Patent No.: US 9,549,591 B2
(45) Date of Patent: Jan. 24, 2017

(54) INSTEP COVER, AND METHOD FOR KNITTING INSTEP COVER

(71) Applicant: SHIMA SEIKI MFG., LTD., Wakayama-shi, Wakayama (JP)

(72) Inventors: Yoshihisa Uchikawa, Wakayama (JP); Masamitsu Ikenaka, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 0 days.

(21) Appl. No.: 15/021,101

(22) PCT Filed: Sep. 5, 2014

(86) PCT No.: PCT/JP2014/073547
§ 371 (c)(1),
(2) Date: Mar. 10, 2016

(87) PCT Pub. No.: WO2015/037540
PCT Pub. Date: Mar. 19, 2015

(65) Prior Publication Data

US 2016/0213097 A1 Jul. 28, 2016

(30) Foreign Application Priority Data

Sep. 13, 2013 (JP) ..... 2013-191134
Jun. 30, 2014 (JP) ..... 2014-134407

(51) Int. Cl.
*D04B 1/24* (2006.01)
*A43B 23/02* (2006.01)
(Continued)

(52) U.S. Cl.
CPC ..... *A43B 23/0245* (2013.01); *A43B 1/04* (2013.01); *A43B 23/0205* (2013.01);
(Continued)

(58) Field of Classification Search
CPC ..... D04B 1/22; D04B 1/24; D04B 1/26; A43B 23/02; A43B 21/00
See application file for complete search history.

(56) References Cited

U.S. PATENT DOCUMENTS 7,774,956 B2 * 8/2010 Dua ..... A43B 1/04 36/45
9,149,086 B2 * 10/2015 Greene ..... A43B 1/04
(Continued)

FOREIGN PATENT DOCUMENTS

JP 2010-508994 A 3/2010
JP 2013-507183 A 3/2013
(Continued)

OTHER PUBLICATIONS

International Search Report issued in PCT/JP2014/073547, Dec. 16, 2014, 2 pgs.

*Primary Examiner* — Danny Worrell
(74) *Attorney, Agent, or Firm* — Rothwell, Figg, Ernst & Manbeck, P.C.

(57) ABSTRACT

An instep cover knitted there-dimensionally in advance, and a method for knitting the same are provided.
An instep cover 1, out of a shoe upper configuring a shoe, which is a seamless knitted fabric knitted using a flat knitting machine including at least a pair of a front and a back needle bed, the instep cover 1 covering a portion on an instep side of a wearer is provided. Assuming in the instep cover 1, a portion that covers a region from an Achilles tendon to a heel of the wearer is a heel cover section 10, and a portion excluding the heel cover section 10 is a body section 11, a stitch in a vicinity of an end in a knitting width direction of the heel cover section 10 and a stitch at an end in a wale direction of the body section 11 are connected at a position of boundary lines L1, L2 of the heel cover section 10 and the body section 11 to form the instep cover 1 three-dimension-
(Continued)

ally; and at least one part of the instep cover 1 is configured with a knitting structure knitted using the front and back needle beds.

9 Claims, 10 Drawing Sheets

(51) Int. Cl.
*A43B 1/04* (2006.01)
*D04B 1/10* (2006.01)

(52) U.S. Cl.
CPC ..... *D04B 1/108* (2013.01); *D04B 1/24* (2013.01); *D10B 2403/0332* (2013.01); *D10B 2501/043* (2013.01)

(56) References Cited

U.S. PATENT DOCUMENTS

| | | | | |
|---|---|---|---|---|
| 2008/0110048 | A1* | 5/2008 | Dua | A43B 1/04 36/45 |
| 2011/0078921 | A1* | 4/2011 | Greene | A43B 1/04 36/47 |
| 2012/0159813 | A1 | 6/2012 | Dua et al. | |
| 2013/0212907 | A1 | 8/2013 | Dua et al. | |

FOREIGN PATENT DOCUMENTS

| | | | |
|---|---|---|---|
| WO | 2008/060928 | A1 | 5/2008 |
| WO | 2011/043998 | A2 | 4/2011 |
| WO | 2014/013790 | A1 | 1/2014 |

* cited by examiner

INSTEP COVER, AND METHOD FOR KNITTING INSTEP COVER

CROSS REFERENCE TO RELATED APPLICATION

This application is a 35 U.S.C. 371 National Phase Entry Application from PCT/JP2014/073547, filed Sep. 5, 2014, which claims the benefit of Japanese Patent Application Nos. 2013-191134 filed Sep. 13, 2013 and 2014-134407 filed Jun. 30, 2014, the disclosures of which are incorporated by reference in their entirety.

TECHNICAL FIELD

The present invention relates to an instep cover that configures a part of a shoe, and a method for knitting the same.

BACKGROUND ART

A shoe has a shoe upper including a sole cover, which covers a sole of a wearer, and an instep cover, which covers a portion on an instep side of the wearer. In outdoor shoes, an outer sole made of synthetic resin and the like is attached to the sole cover of the shoe upper. Attempts have been made in recent years to configure the instep cover, out of the instep cover and the sole cover configuring the shoe upper, with one knitted fabric to produce the shoes with high productivity. For example, Patent Documents 1 to 3 disclose a technique of producing the instep cover, which is in a state where the heel portion is divided to the right and left and is not connected, with one knitted fabric, and joining such instep cover to the outer sole made of synthetic resin and the like along with the sole cover prepared separately from the instep cover to complete the shoe.

PRIOR ART DOCUMENTS

Patent Documents

[Patent Document 1] Japanese Patent application Publication No. 2010-508994

[Patent Document 2] US Patent Application Publication No. 2012/0159813

[Patent Document 3] US Patent Application Publication No. 2013/0212907

DISCLOSURE OF THE INVENTION

Problems to be Solved by the Invention

In the techniques of Patent Documents 1 to 3, a part of the instep cover needs to be sewn to connect the portion divided to the right and left of the instep cover to form a three-dimensional shape. Since the sewing operation is troublesome, the manufacturing of the shoes using the techniques of Patent Documents 1 to 3 has a problem in that the production efficiency (time, cost, etc.) of the shoes is not satisfactory.

With regards to the problem described above, the productivity of the shoes is assumed to be enhanced if the instep cover knitted three-dimensionally with the portion of the heel connected in advance is provided. However, such instep cover and a method for knitting the same have not yet been proposed.

The present invention has been made in light of the foregoing, and an object of the present invention is to provide an instep cover knitted three-dimensionally in advance, and a method for knitting the same.

Means for Solving the Problems

An aspect of the present invention relates to an instep cover, out of a shoe upper configuring a shoe, which is a seamless knitted fabric knitted using a flat knitting machine including at least a pair of a front and a back needle bed, the instep cover covering a portion on an instep side of a wearer. In the instep cover, a portion that covers a region from an Achilles tendon to a heel of the wearer is assumed as a heel cover section, and a portion excluding the heel cover section is assumed as a body section, where a stitch in a vicinity of an end in a knitting width direction of the heel cover section and a stitch at an end in a wale direction of the body section are connected at a position of a boundary line of the heel cover section and the body section to form the instep cover three-dimensionally; and at least one part of the instep cover is configured with a knitting structure knitted using the front and back needle beds.

According to one aspect of the instep cover of the present invention, the heel cover section has a shape in which a width gradually becomes narrower from a lower end side toward an upper end side of the instep cover.

According to one aspect of the instep cover of the present invention, a shape retaining section is arranged, the shape retaining section being connected to at least one of a lower end on a toe side or a lower end on a heel side of a cover main body configured by the heel cover section and the body section, and bent toward an inward side of an opening on the lower end side of the cover main body to retain the cover main body in a three-dimensional shape lying along a shape of a foot of the wearer. In particular, as shown in the fourth embodiment, as will be described later, a stitch at an end in a wale direction of the shape retaining section is preferably continued to an end in a wale direction of the cover main body at an intermediate portion of a contour of a connecting portion to the cover main body in the shape retaining section; and a stitch at the end in the wale direction of the shape retaining section is preferably connected to an end in the knitting width direction of the cover main body by knitting at both side edge portions excluding the intermediate portion.

According to one aspect of the instep cover of the present invention, the shape retaining section is a back side shape retaining section connected to the lower end of the heel cover section and the lower end of the body section at a position sandwiching the heel cover section, a contour of a connecting portion to the heel cover section and the body section in the back side shape retaining section being formed to a hill shape. A stitch at an end in a wale direction of the back side shape retaining section is continued to an end in a wale direction of the heel cover section at an intermediate portion of the hill shaped contour; and a stitch at the end in the wale direction of the back side shape retaining section is connected to an end in the knitting width direction of the body section by knitting at both side edge portions excluding the intermediate portion in the hill shaped contour. The hill shaped contour includes an arch-like contour and a trapezoidal contour. The significance of the contour is the same in the following front side shape retaining section.

According to one aspect of the instep cover of the present invention, the shape retaining section is a front side shape retaining section connected to a lower end of a portion on a toe side of the body section, a contour of a connecting portion to the body section in the front side shape retaining section being formed to a hill shape. A stitch at an end in a wale direction of the front side shape retaining section is continued to an end in a wale direction of the body section at an intermediate portion of the hill shaped contour; and a stitch at the end in the wale direction of the front side shape retaining section is connected to the end in the knitting width direction of the body section by knitting at both side edge portions excluding the intermediate portion in the hill shaped contour.

An aspect of the present invention relates to a method (hereinafter referred to as knitting method I) for knitting an instep cover that covers a portion on an instep side of a wearer, of a shoe upper configuring a shoe, with a flat knitting machine including at least a pair of a front and a back needle bed. According to the knitting method I of the present invention, in the instep cover, a portion that covers a region from an Achilles tendon to a heel of the wearer is assumed as a heel cover section, and a portion excluding the heel cover section is assumed as a body section, where the following process α to process γ are sequentially carried out, and a knitting structure is knitted using the front and back needle beds in at least one part of the process α to the process γ.

[Process α] Process of knitting the body section from a toe side toward a heel side to complete the body section, a left side portion and a right side portion of the body section being knitted while being arranged side by side on the needle beds.

[Process β] Process of knitting a set up portion to become an upper end of the heel cover section between a terminating stitch row of the left side portion and a terminating stitch row of the right side portion in a longitudinal direction of the needle beds.

[Process γ] Process of repeating knitting of a stitch row to become the heel cover section following the wale direction of the set up portion and connecting of a stitch on one end side and a stitch on the other end side in a knitting width direction of the stitch row to a stitch of the terminating stitch row of the left side portion and a stitch of the terminating stitch row of the right side portion respectively to complete the heel cover section.

According to one aspect of the knitting method I, at least one of process α' and process γ' is carried out.

[Process α'] Process of knitting a front side shape retaining section, a knitted fabric in which a knitting width is gradually increased from a starting end toward a terminating end in a wale direction, for retaining a portion on the toe side of the instep cover in a three-dimensional shape lying along the roundness of the toe of the wearer before the process α. When carrying out the process α', in the process α, the body section is set up in continuation to a center stitch row at the terminating end in the wale direction of the front side shape retaining section, and a stitch at the end in the knitting width direction of the body section is formed on a side stitch row excluding the center stitch row at the terminating end in the wale direction of the front side shape retaining section when increasing the number of knitting courses of the body section.

[Process γ'] Process of knitting a back side shape retaining section, a knitted fabric in which a knitting width is gradually narrowed from a starting end toward a terminating end in a wale direction, for retaining a portion on the heel side of the instep cover in a three-dimensional shape lying along the roundness of the heel of the wearer after the process γ. When carrying out the process γ', in the process γ', the back side shape retaining section is set up in continuation to the terminating end in the wale direction of the heel cover section and the end in the knitting width direction of the body section at a position sandwiching the terminating end in the wale direction.

An aspect of the present invention relates to a method (hereinafter referred to as knitting method II) for knitting an instep cover that covers a portion on an instep side of a wearer, of a shoe upper configuring a shoe, with a flat knitting machine including at least a pair of a front and a back needle bed. According to the knitting method II of the present invention, in the instep cover, a portion that covers a region from an Achilles tendon to a heel of the wearer is assumed as a heel cover section, and a portion excluding the heel cover section is assumed as a body section, where the following process δ to process ξ are sequentially carried out, and a knitting structure is knitted using the front and back needle beds in at least one part of the process δ to the process ξ.

[Process δ] Process of knitting the heel cover section from a lower end side toward an upper end side while gradually narrowing a knitting width to complete the heel cover section.

[Process ϵ] Process of setting up a left side portion of the body section following an edge on one end side in the knitting width direction of the heel cover section and setting up a right side portion of the body section following an edge on the other end side in the knitting width direction of the heel cover section.

[Process ξ] Process of knitting the body section from the heel side toward the toe side to complete the body section, a left side portion and the right side portion of the body section being knitted while being arranged side by side on the needle beds.

According to one aspect of the knitting method II, at least one of process δ' and process ξ' is carried out.

[Process δ'] Process of knitting a back side shape retaining section, a knitted fabric in which a knitting width is gradually increased from a starting end toward a terminating end in a wale direction, for retaining a portion on the heel side of the instep cover in a three-dimensional shape lying along the roundness of the heel of the wearer before the process δ. When carrying out the process δ', in the process δ, the heel cover section is set up in continuation to a center stitch row at the terminating end in the wale direction of the back side shape retaining section, and in the process ξ, a stitch at the end in the knitting width direction of the body section is sequentially formed on a side stitch row excluding the center stitch row at the terminating end in the wale direction of the back side shape retaining section when increasing the number of knitting courses of the body section.

[Process ξ'] Process of knitting a front side shape retaining section, a knitted fabric in which a knitting width is gradually narrowed from a starting end toward a terminating end in a wale direction, for retaining a portion on the toe side of the instep cover in a three-dimensional shape lying along the roundness of the toe of the wearer after the process ξ. In the process ξ', the front side shape retaining section is set up in continuation to the terminating end in the wale direction of the body section and the end in the knitting width direction of the body section at a position sandwiching the terminating end in the wale direction.

Effect of the Invention

The instep cover of the present invention is a seamless instep cover formed to a three-dimensional shape. This is because the instep cover is knitted separately for the heel cover section and the body section, and the end in the knitting width direction of the heel cover section and the end in the wale direction of the body section are connected by knitting. The heel cover section and the body section in such a connecting state support each other, thus maintaining the heel side portion of the instep cover in a three-dimensional shape. The three dimensional instep cover of the present invention has an effect of enhancing the productivity of the shoe. This is because the sewing operation required for the instep cover of Patent Documents 1 to 3 is not required for the instep cover of the present invention. Furthermore, according to the three dimensional instep cover of the present invention, the fact that the instep cover and the sole cover can be easily aligned when combining the instep cover with the sole cover to obtain the shoe is one of the factors the productivity of the shoes can be enhanced.

The instep cover of the present invention is stout as it is configured with a thick knitting structure in which at least one part thereof is knitted using front and back needle beds. The instep cover that is less likely to lose shape and that is steadier can be obtained by configuring the instep cover of the shoe, which is subjected to load during use, with a thick knitting structure.

If the heel cover section has a shape in which the width gradually becomes narrower from the lower end side toward the upper end side of the instep cover, the shape of the portion on the heel side of the instep cover can be made to a shape closer to the shape of the foot of the wearer. This is because, since the width on the lower end side (i.e., bottom side) of the heel cover section is wide, the portion on the heel side of the instep cover can be rounded.

The shape retaining section is formed in at least one of the toe side or the heel side of the cover main body configured by the heel cover section and the body section, so that the shape of the portion including the shape retaining section of the cover main body (i.e., instep cover) can be formed to a three-dimensional shape. In particular, with the front side shape retaining section (back side shape retaining section) having connection of stitches described above, the shape of the toe side (heel side) of the cover main body can be formed to a three-dimensional shape that further lies along the shape of the foot of the wearer.

According to the knitting method I and the knitting method II, the instep cover of the present invention can be knitted. In either knitting method, the left side portion and the right side portion of the body section are knitted while being arranged side by side on the needle beds, and hence the body section can be knitted using the front and back needle beds. As a result, the body section becomes the thick knitting structure compared to the knitting structure of plain knitting and the like. The heel cover section may, of course, be knitted using the front and back needle beds.

According to the knitting method I and the knitting method II for knitting the back side shape retaining section or the front side shape retaining section, the instep cover can be formed more three-dimensionally compared to the instep cover including only the heel cover section.

MODE FOR CARRYING OUT THE INVENTION

Hereinafter, embodiments of an instep cover and a method for knitting the same according to the present invention will be described based on the drawings. In any of the embodiments, a two-bed flat knitting machine including at least a pair of a front and a back needle bed is used to knit the instep cover. The instep cover of the present invention may, of course, be knitted with a four-bed flat knitting machine and the like.

First Embodiment

Overall Configuration

Figure 1:
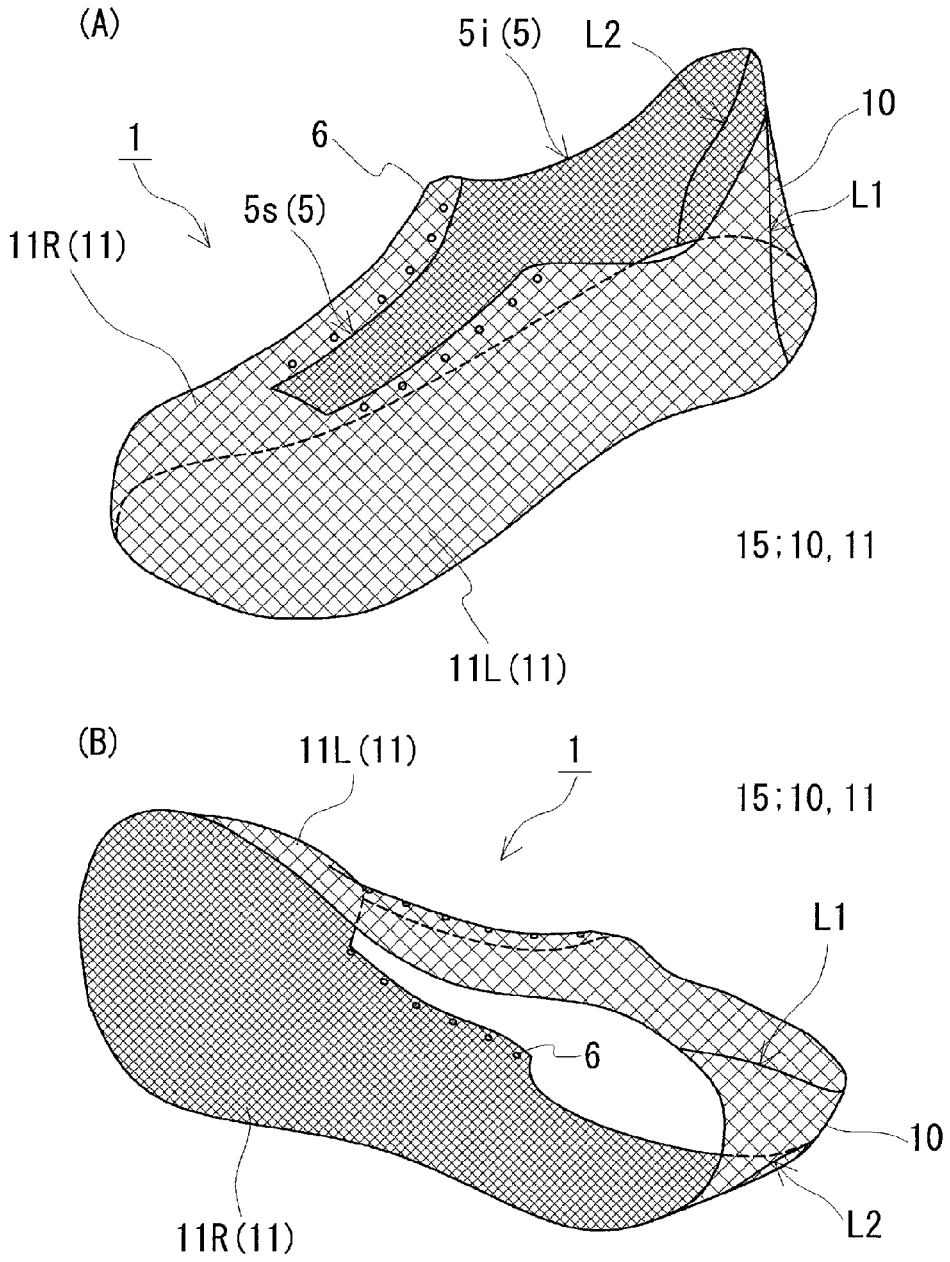
FIG. 1(A) is a schematic upper perspective view of an instep cover shown in a first embodiment.
FIG. 1(B) is a schematic lower perspective view of the instep cover.

In a first embodiment, an example of knitting an instep cover 1 shown in FIG. 1 will be described. A portion indicated with a large cross hatching in the drawing represents the front side (outer side) of the instep cover 1, and a portion indicated with a small cross hatching represents the back side (inner side) of the instep cover 1.

The instep cover 1 is a member that covers an instep side portion of a wearer in the shoe, and is a member that is knitted in a seamless manner using a flat knitting machine. At least one part of the instep cover 1 is preferably knitted using a fusible knitting yarn including a heat fusible yarn. A shoe opening 5 is formed on an upper side of the instep cover 1, where such shoe opening 5 is configured by a foot insertion opening 5*i*, to which the wearer inserts the foot, and a slit 5*s*, which extends from the foot insertion opening 5*i* toward a toe side. An eyelet hole 6 for passing a shoelace is formed at a position of the slit 5*s* in the instep cover 1. The eyelet hole 6 is not necessary in a shoe that does not use a shoelace. The instep cover 1 without the slit 5*s* can, of course, be adopted.

A sole cover (not shown) that covers a sole portion of the wearer is combined with the opening on a lower end side of the instep cover 1 (see FIG. 1(B)), and an outer sole (not shown) made of resin and the like is attached to the outer side of such sole cover to complete the shoe.

The instep cover 1 can be formed three-dimensionally even if the sole cover and the outer sole are not attached. In particular, the portion on the heel side of the instep cover 1 is formed three-dimensionally. This is because the instep cover 1 is knitted separately for a heel cover section 10 and a body section 11, as shown in a method for knitting the instep cover, to be described later. Hereinafter, the heel cover section 10 and the body section 11 may be collectively referred to as a cover main body 15.

<<Heel Cover Section>>

The heel cover section 10 configuring the instep cover 1 is a portion that covers a region from the Achilles tendon to the heel of the wearer. The heel cover section 10 has a size extending from an upper end (i.e., side of opening 5*i*) to a lower end (sole side of a shoe) of the instep cover 1. The width of the heel cover section 10 (length in a shoe width direction of the instep cover 1) may be constant or may be different from the upper end to the lower end of the instep cover 1. The heel cover section 10 of the present embodiment has a shape in which the width gradually becomes narrower from the lower end side toward the upper end side. The heel cover section 10 may have a shape in which the width gradually becomes narrower from the upper end side toward the lower end side of the heel cover section 10.

Stitches configuring the heel cover section 10 are directed toward the upper side or the lower side in the height direction of the instep cover 1. Whether the stitches are directed toward the upper side or directed toward the lower side depends on the procedure of the knitting method to be described later. In any case, the height direction of the instep cover 1 becomes the wale direction of the heel cover section 10, and the width direction of the instep cover 1 becomes the knitting width direction of the heel cover section 10. Therefore, stitches at the ends in the knitting width direction of the heel cover section 10 are lined on boundary lines L1, L2 of the heel cover section 10 and the body section 11.

<<Body Section>>

The body section 11 is a portion excluding the heel cover section 10 in the instep cover 1. The stitches configuring the body section 11 are directed toward the heel side or the toe side in the length direction of the instep cover 1. That is, the length direction of the instep cover 1 becomes the wale direction of the body section 11, and the height direction of the instep cover 1 becomes the knitting width direction of the body section 11. Therefore, stitches at the ends in the wale direction of the body section 11 are lined on the boundary lines L1, L2.

A portion corresponding to the sole cover in the shoe upper is not connected to a side edge of the body section 11. That is, in a left side portion 11L (right side portion 11R) of the body section 11, a lower end side (sole side of a shoe) of the instep cover 1 is the turning-back end of the knitting. This is similar in any embodiments described hereinafter.

<<Connection of Heel Cover Section and Body Section>>

The heel cover section 10 and the body section 11, in which the direction of the stitches differs, are connected at the positions of the boundary lines L1, L2. More specifically, stitches in the vicinity of the end in the knitting width direction of the heel cover section 10 (stitches at the end, or stitches one or two stitches on the inner side from the end) and the stitches at the end in the wale direction of the left side portion 11L (right side portion 11R) of the body section 11 are connected at the position of the boundary line L1 (L2). When the heel cover section 10 and the body section 11 are connected in such connecting relationship, a state in which the heel cover section 10 and the body section 11 support each other is obtained. Consequently, the shape of the instep cover 1, particularly, the portion on the heel side is retained in a three-dimensional shape. According to the instep cover 1 formed three-dimensionally in advance, the productivity of the shoe can be enhanced when combining the sole cover and the outer sole to produce the shoe. This is because the instep cover 1 does not require the sewing operation for forming the instep cover three-dimensionally, which is required in the instep covers described in Patent Documents 1 to 3.

<<Knitting Structure of Instep Cover>>

At least one part of the instep cover 1 (the heel cover section 10 and the body section 11), or the entire instep cover 1 in the present embodiment is configured with a knitting structure knitted using front and back needle beds. It is apparent that the knitting structure is knitted using the front and back needle beds by examining the state of the stitches of the knitted fabric and the connection of the knitting yarn. Such knitting structure is thicker and more robust than the knitting structures such as plain stitches. The instep cover 1 that is less likely to lose shape and that is steadier can be obtained, and the durability of the shoe can be enhanced by configuring the instep cover 1 of the shoe, which is subjected to load during use, with a thick knitting structure. The method for knitting the thick knitting structure will be described later.

<<Method for Knitting Instep Cover>>

The instep cover 1 can be knitted according to knitting method I or knitting method II below.

Knitting method I: Knitting method of knitting the body section 11 from the toe side toward the heel side, and then knitting the heel cover section 10 from the upper end side toward the lower end side.

Knitting method II: Knitting method of knitting the heel cover section 10 from the lower end side toward the upper end side, and then knitting the body section 11 from the heel side toward the toe side.

The knitting method I and the knitting method II will be sequentially described below.

[Knitting Method I]

Figure 2:
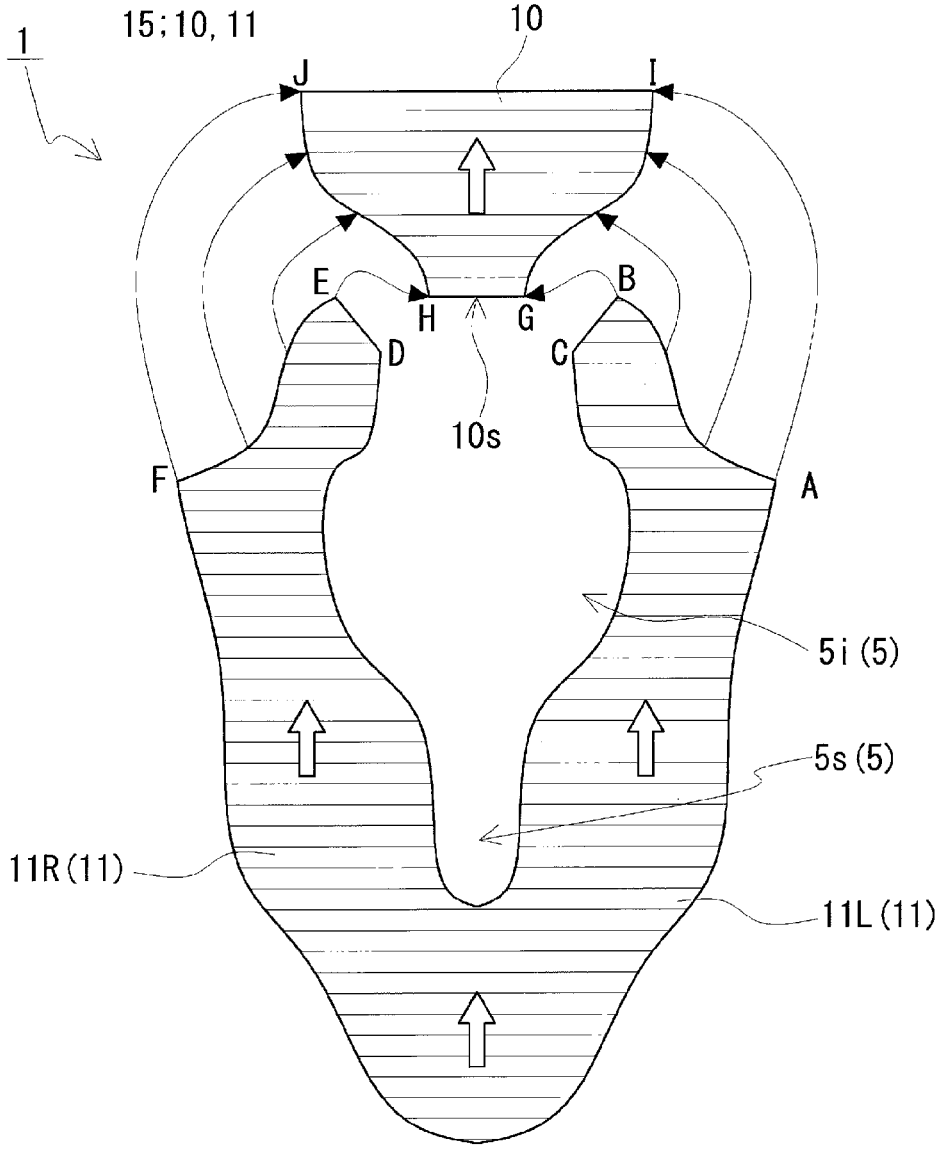
FIG. 2 is a schematic view showing a knitting procedure of the instep cover shown in the first embodiment.

FIG. 2 is used to explain the knitting method I. FIG. 2 is a schematic view showing a knitting procedure of the knitting method I. An outlined arrow of FIG. 2 indicates an advancing direction (same as wale direction) of the knitting, and a horizontal line in each section 10, 11 indicates the knitting width direction (direction in which stitches are lined). Furthermore, upper case alphabets are denoted on the portions to become the important areas in the knitting in the drawing. The significance of the outlined arrow, the horizontal lines, and the alphabets is common among FIGS. 4, 6, 7, 9, and 10.

In the knitting method I, process α of knitting the body section 11 from the toe side toward the heel side to complete the body section 11 is first carried out. In this case, the left side portion 11L and the right side portion 11R of the body section 11 are knitted while being arranged side by side on the needle beds. The knitting structure and the knitting yarn may be partially changed in the knitting of the body section 11.

In the process α, the knitting width of the left side portion 11L and the right side portion 11R is appropriately increased or reduced so that both portions 11L, 11R are shaped to lie along the foot of the wearer. In the present embodiment, the knitting width of the portions 11L, 11R is gradually reduced on the heel side of the body section 11 in view of the shape of the heel cover section 10 to be knitted after the body section 11. Thus, the stitches at the terminating end in the wale direction of the left side portion 11L are lined on point A-point B for the left side portion 11L, and the stitches at the terminating end in the wale direction of the right side portion 11R are lined on point E-point F for the right side portion 11R.

Following the process α, process β of knitting a set up portion 10*s* (see point G-point H) to become the upper end of the heel cover section 10 between a terminating stitch row (see pint A-point B) of the left side portion 11L and a terminating stitch row (see point E-point F) of the right side portion 11R in the longitudinal direction of the needle beds is carried out.

Following the process β, process γ of repeating the knitting of a stitch row to become the heel cover section 10 following the wale direction of the set up portion 10*s* and the connecting of the stitch (stitch of point G-point I) on one end side and the stitch (stitch of point H-point J) on the other end side in the knitting width direction of the stitch row to the stitch of the terminating stitch row of the left side portion 11L and the stitch of the terminating stitch row of the right side portion 11R, respectively, to complete the heel cover section 10 is carried out. The stitch on one end side (stitch on the other end side) is the stitch on the left side portion 11L side (right side portion 11R side) of the plurality of stitches lined in the knitting width direction. When connecting the heel cover section 10 and the body section 11, the stitches of the body section 11 may be moved toward the heel cover section 10 side to overlap the stitches of the sections 10, 11. The double stitches are fixed and the heel cover section 10 and the body section 11 are connected by knitting the stitch row of the heel cover section 10 following the wale direction of the double stitches.

The heel cover section 10 may have a symmetrical shape or may have an asymmetrical shape in accordance with the shapes of the right and left feet. The knitting yarn configuring the heel cover section 10 may be the same as or different from the knitting yarn configuring the body section 11.

According to the procedures described above, the instep cover 1 of FIG. 1 in which the end in the knitting width direction of the heel cover section 10 and the end in the wale direction of the body section 11 are connected at the positions of the boundary lines L1, L2 in the instep cover 1 can be knitted. The stitches of the body section 11 of the instep cover 1 knitted according to such procedure are directed toward the heel side and the stitches of the heel cover section 10 are directed toward the lower side.

In the present embodiment, the entire instep cover 1 is a thick knitting structure. The thick knitting structure is knitted using the front and back needle beds. The method for knitting such thick knitting structure may be any knitting method that gives thickness to the knitting structure using the front and back needle beds, and is not particularly limited. For example, the knitting that uses the front and back needle beds such as rib knitting, tubular knitting and the like may be appropriately combined to knit the thick knitting structure. A knitting example of the thick knitting structure that uses the tubular knitting will be hereinafter described based on FIG. 3.

Figure 3:
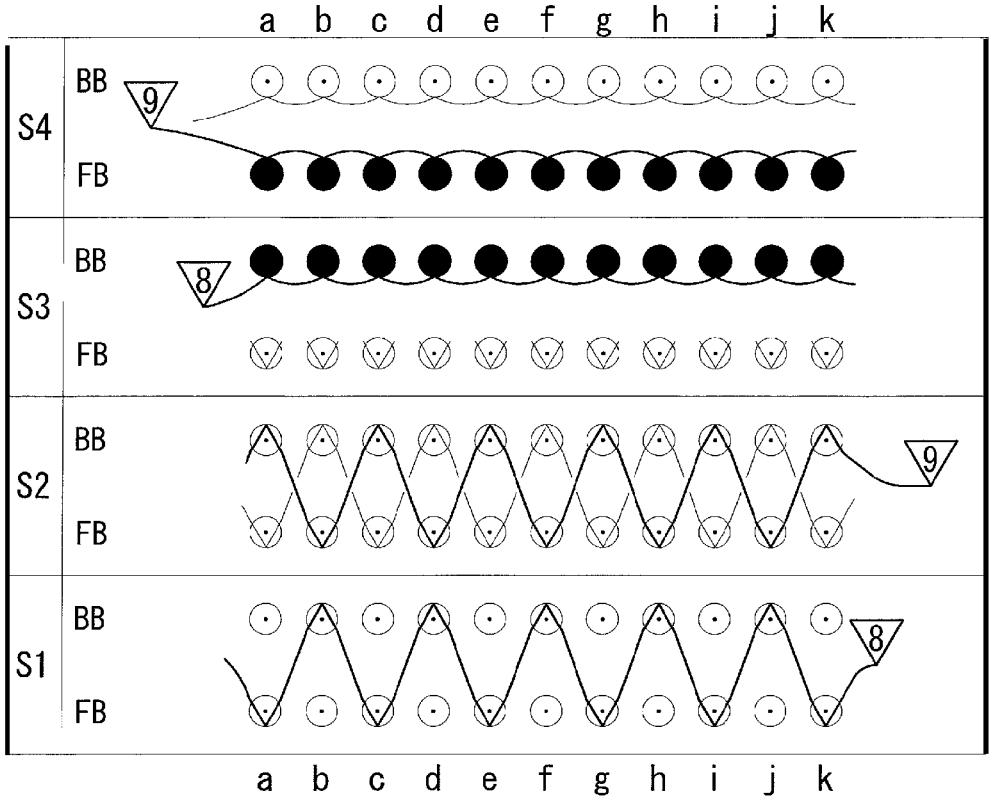
FIG. 3 is a knitting process diagram of a knitting structure using the front and back needle beds.

FIG. 3 is a knitting process diagram showing one example of a method for knitting a thick knitting structure. "S+number" in FIG. 3 indicates the number of the knitting process, the black dot in the right column indicates the knitting needle of the front needle bed (FB) and the back needle bed (BB), a V mark indicates a tuck stitch, a black circle indicates a new stitch knitted in each process, and a white circle indicates an old stitch. The position of the knitting needle in FIG. 3 is specified with a lower case alphabet.

In S1, a yarn feeder 8 is used to alternately tuck knit on the knitting needles a, c, e, g, i, k of the FB and the knitting needles b, d, f, h, j of the BB. In S2, a yarn feeder 9 is used to alternately tuck knit on the knitting needles on which pickup stitches are not formed in S1. In S3, the yarn feeder 8 is used to knit a stitch row following the wale direction of all the stitches held on the BB. In S4, the yarn feeder 9 is used to knit a stitch row following the wale direction of all the stitches held on the FB. Thereafter, the knitting similar to S1 to S4 is repeated. As a result, the thick knitting structure is formed by the stitch rows knitted with tubular knitting shown in S3 and S4.

As described with reference to FIG. 3, the front and back needle beds are used for the knitting of the thick knitting structure because the left side portion 11L and the right side portion 11R are knitted while being arranged side by side, and the knitting region of the left side portion 11L and the knitting region of the right side portion 11R in the longitudinal direction of the needle beds are not overlapped, as shown in FIG. 2.

When starting the knitting of the heel cover section 10 as shown in FIG. 2 after knitting the left side portion 11L and the right side portion 11R through the knitting method shown in FIG. 3, the stitches on the BB side of each portion 11L, 11R are overlapped on the stitches on the FB side to form empty needles on the BB for moving the portions 11L, 11R toward the heel cover section 10 (this is not the sole case when transfer can be carried out without providing the empty needles on the FB and the BB such as with the four bed flat knitting machine and the like). Furthermore, the width of the heel cover section 10 is made the width to overlap the end in the wale direction of the body section 11 when joining the body section 11 and the heel cover section 10, so that the stitches of the body section 11 do not need to be moved toward the heel cover section 10, and the stitches can be avoided from being damaged.

[Knitting Method II]

Figure 4:
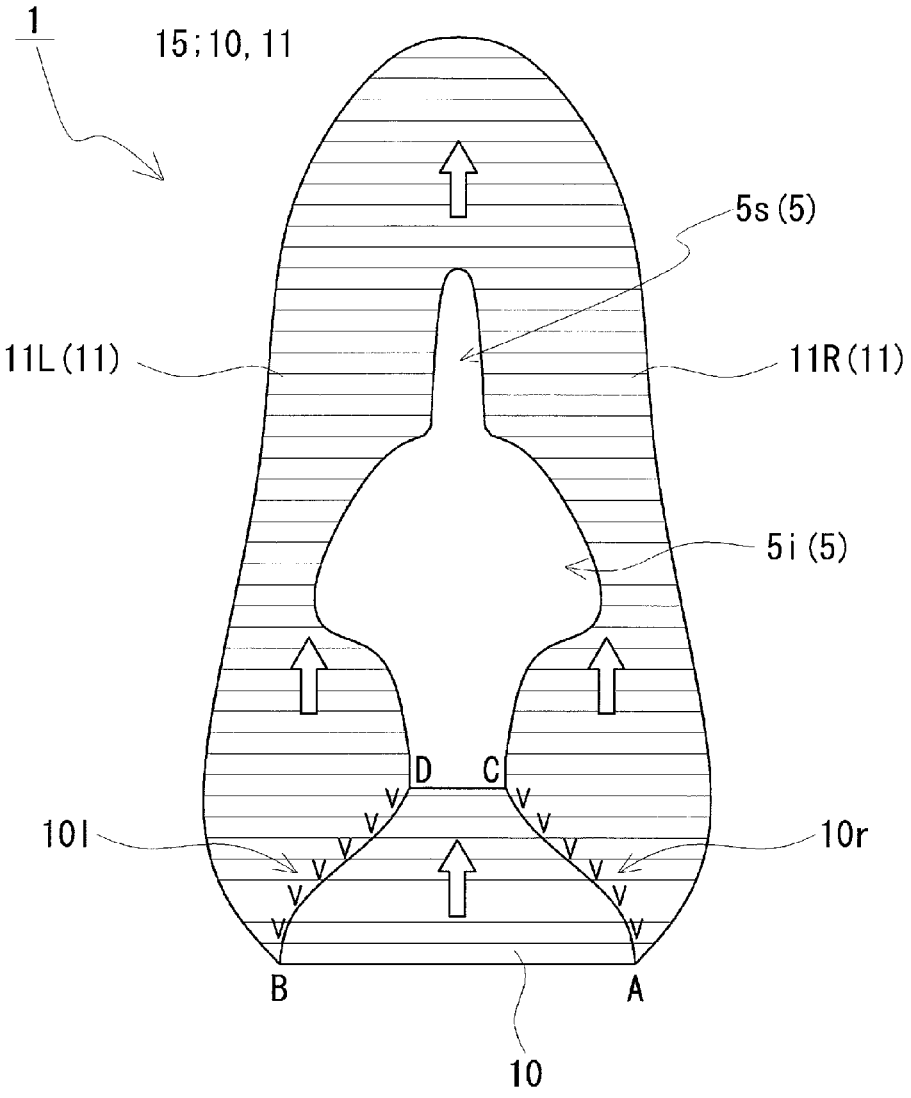
FIG. 4 is a schematic view showing another knitting procedure of the instep cover shown in the first embodiment.

FIG. 4 is used to describe the knitting method II in which the knitting is carried out in the order opposite the knitting method I. FIG. 4 is a schematic view showing the knitting procedure of the knitting method II, and can be viewed in the same manner as FIG. 2.

In the knitting method II, process δ of knitting the heel cover section 10 while gradually narrowing the knitting width from the lower end side (lower side in the plane of drawing) toward the upper end side of the instep cover 1 to complete the heel cover section 10 is first carried out. Specifically, the set up portion (see point A-point B) of the heel cover section 10 is knitted, and a plurality of stitch rows following the wale direction of the set up portion is knitted. In this case, the knitting width of the stitch row is gradually narrowed. A stitch (see V mark) lined at the edge 101 (see point B-point D) on one end side in the knitting width direction of the heel cover section 10 and a stitch (see V mark) lined at the edge 10*r* (see point A-point C) on the other end side obtained as a result are held on the needle beds. The terminating end in the wale direction (see point C-point D) of the heel cover section 10 is removed from the needle bed through the bind-off process and the like.

After the process δ, process ϵ of setting up the left side portion 11L of the body section 11 following the edge 101 on one end side in the knitting width direction of the heel cover section 10 and setting up the right side portion 11R of the body section 11 following the edge 10*r* on the other end side in the knitting width direction of the heel cover section 10 is carried out. The left side portion 11L and the right side portion 11R are knitted using different yarn feeders.

After the process ϵ, process ξ of knitting the body section 11 from the heel side toward the toe side to complete the body section 11, the process including knitting the left side portion 11L and the right side portion 11R of the body section 11 arranged side by side on the needle beds, is carried out. In this case, the knitting width of the left side portion 11L and the right side portion 11R is appropriately increased and reduced in accordance with the shape of the foot. Furthermore, after knitting the left side portion 11L and the right side portion 11R to the position of the distal end of the slit 5*s* of the shoe opening 5, the portions 11L, 11R are put together, and the body section 11 is knitted to the toe. Since the operation of moving the stitches of the heel cover section 10 is not necessary when knitting the portions 11L, 11R, the stitches of the heel cover section 10 can be avoided from being damaged by the move.

According to the procedure described above, the instep cover 1 shown in FIG. 1 in which the portion on the heel side is formed three-dimensionally can be knitted. The stitches of the heel cover section 10 in such instep cover 1 are directed toward the upper side, and the stitches of the body section 11 are directed toward the toe side.

Second Embodiment

Figure 5:
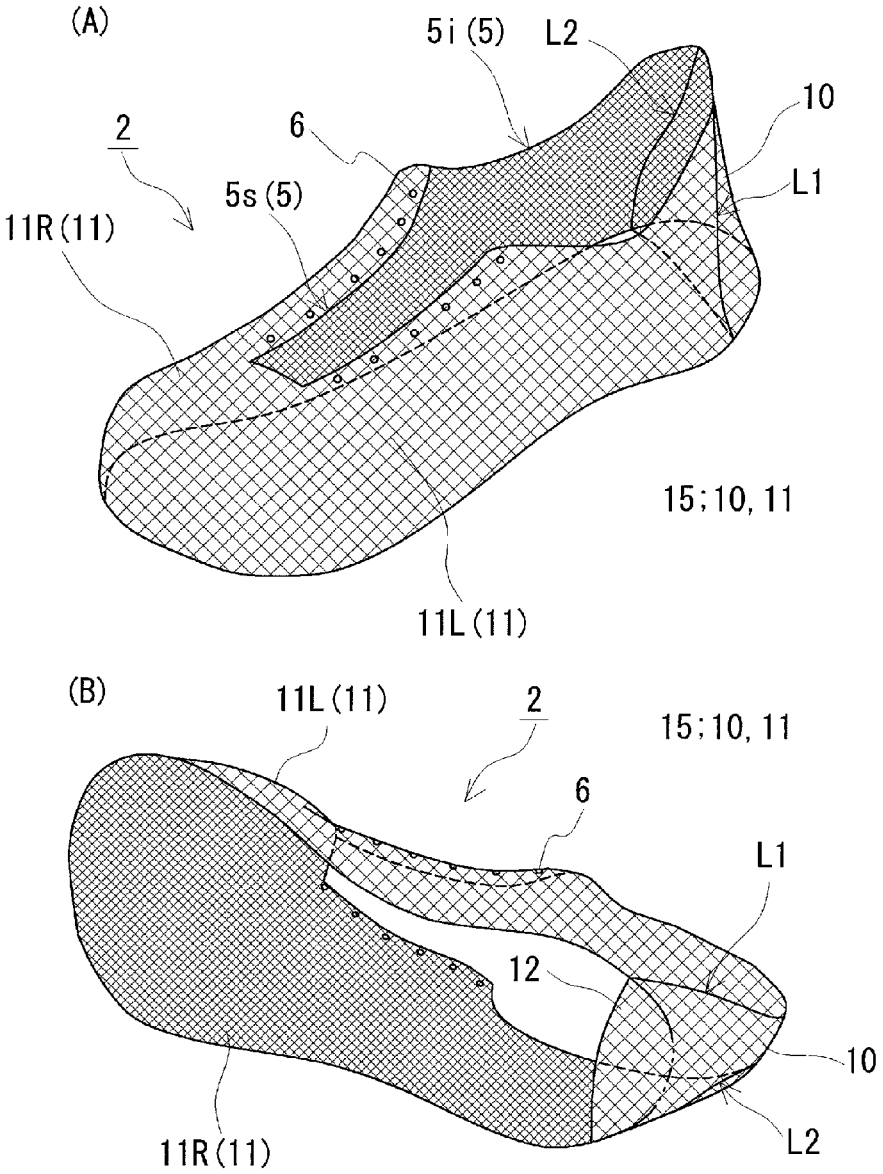
FIG. 5(A) is a schematic upper perspective view of an instep cover shown in a second embodiment.
FIG. 5(B) is a schematic lower perspective view of the instep cover.

In a second embodiment, an instep cover 2 including a shape retaining section 12 in addition to the configuration of the first embodiment will be described based on FIG. 5. The method for knitting the instep cover 2 will be described based on FIG. 6.

<<Configuration of Instep Cover>>

As shown in FIG. 5(B), the shape retaining section 12 is connected to the lower end side of the heel cover section 10 and bent toward the inward side of the opening on the lower end side of the cover main body 15 to retain the portion on the heel side of the instep cover 2 in a three-dimensional shape along the roundness of the heel of the wearer. A contour of the connecting portion to the heel cover section 10 in the shape retaining section 12 is formed to a hill shape.

The shape retaining section 12 has a shape in which the knitting width gradually widens as it moves away from the connecting side with the heel cover section 10, and the heel of the instep cover 2 becomes three dimensional by the difference in the number of stitches in the knitting course lined in the wale direction. That is, the stitches at the end in the wale direction of the shape retaining section 12 are lined at the intermediate portion of the contour in the shape retaining section 12, and the stitches at the end in the knitting width direction of the shape retaining section 12 are lined at both side edge portions excluding the intermediate portion of the contour. Therefore the stitch at the end in the wale direction of the heel cover section 10 and the stitch at the end in the wale direction of the shape retaining section 12 are continued at the intermediate portion of the contour, and a seam in appearance is not found between the heel cover section 10 and the shape retaining section 12. The stitch at the end in the wale direction of the heel cover section 10 and the stitch at the end in the knitting width direction of the shape retaining section 12 are connected by knitting at both side edge portions of the contour, and a seam is found between the heel cover section 10 and the shape retaining section 12.

The heel cover section 10 and the shape retaining section 12 in a connecting relationship described above support each other, similar to the heel cover section 10 and the body section 11 that support each other. Thus, the portion on the lower end side of the heel cover section 10 is maintained in a three-dimensional shape along the roundness of the heel of the wearer by the shape retaining section 12. As a result, the instep cover 1 of the second embodiment becomes the instep cover 2 that lies more along the shape of the foot of the wearer.

<<Method for Knitting Instep Cover>>

Figure 6:
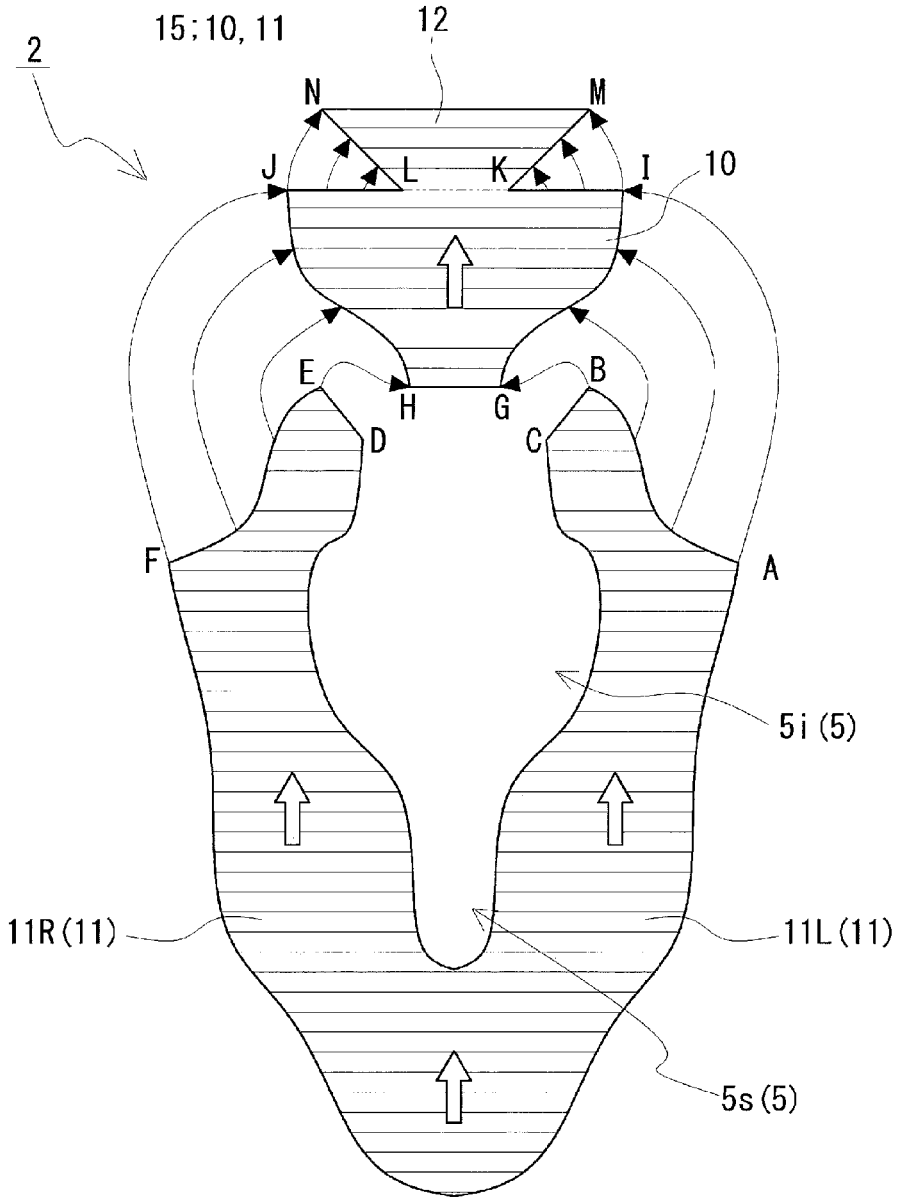
FIG. 6 is a schematic view showing a knitting procedure of the instep cover shown in the second embodiment.

The instep cover 2 can be knitted according to the knitting procedure shown in FIG. 6. In FIG. 6, the knitting is carried out from the toe side toward the heel side of the body section 11, and the knitting procedure of the body section 11 and the heel cover section 10 is exactly the same as the knitting method I that references FIG. 2.

In the instep cover 2 of the present embodiment, the shape retaining section 12 is further knitted following the wale direction of the heel cover section 10. More specifically, the shape retaining section 12 is set up following the wale direction of some stitches (see point K-point L) in an intermediate region of the stitch row at the terminating end in the wale direction of the heel cover section 10. The shape retaining section 12 including a plurality of stitch rows in which the knitting width is gradually increased is then knitted following the set up portion of the shape retaining section 12. In this case, the stitches (see point K-point I, point L-point J) at the end in the wale direction of the heel cover section 10 and the stitches (see point K-point M, point L-point N) at the end in the knitting width direction of the shape retaining section 12 are connected.

According to the procedure described above, the instep cover 2 shown in FIG. 5 in which the end in the wale direction of the heel cover section 10 and the end in the knitting width direction of the shape retaining section 12 are connected can be knitted at the position of an oblique portion of the shape retaining section 12. The instep cover 2 is more maintained in a three-dimensional shape lying along the shape of the foot of the wearer than the configuration of the first embodiment by the shape retaining section 12. Furthermore, when the instep cover 2 is fitted to a last (foot model) and subjected to thermal processing, the shape retaining section 12 is hooked at the position of the heel of the last, and thus the instep cover 2 is easily fitted to the last and the position of the instep cover 2 is less likely to shift with respect to the last. Moreover, in the instep cover 2 knitted according to the procedure described above, the appearance of the instep cover 2 can be enhanced since the knitting end portion of the instep cover 2 (knitting end portion of shape retaining section 12) is hidden on the sole side.

The knitting width (length of point M-point N) at the terminating end in the wale direction of the shape retaining section 12 may be made longer than the knitting with (length of point I-point J) at the terminating end in the wale direction of the heel cover section 10. In this case, the extra stitch that is not connected to the heel cover section 10 of the stitches (see point K-point M, point L-point N) at the end in the knitting width direction of the shape retaining section 12 may be connected to the stitch at the end in the knitting width direction in the vicinity of the points A, F in the body section 11. The shape on the heel side of the cover main body 15 thus can be formed to a more three-dimensional shape.

The instep cover 2 of the second embodiment may be knitted in the order of shape retaining section 12→heel cover section 10→body section 11.

Third Embodiment

Figure 7:
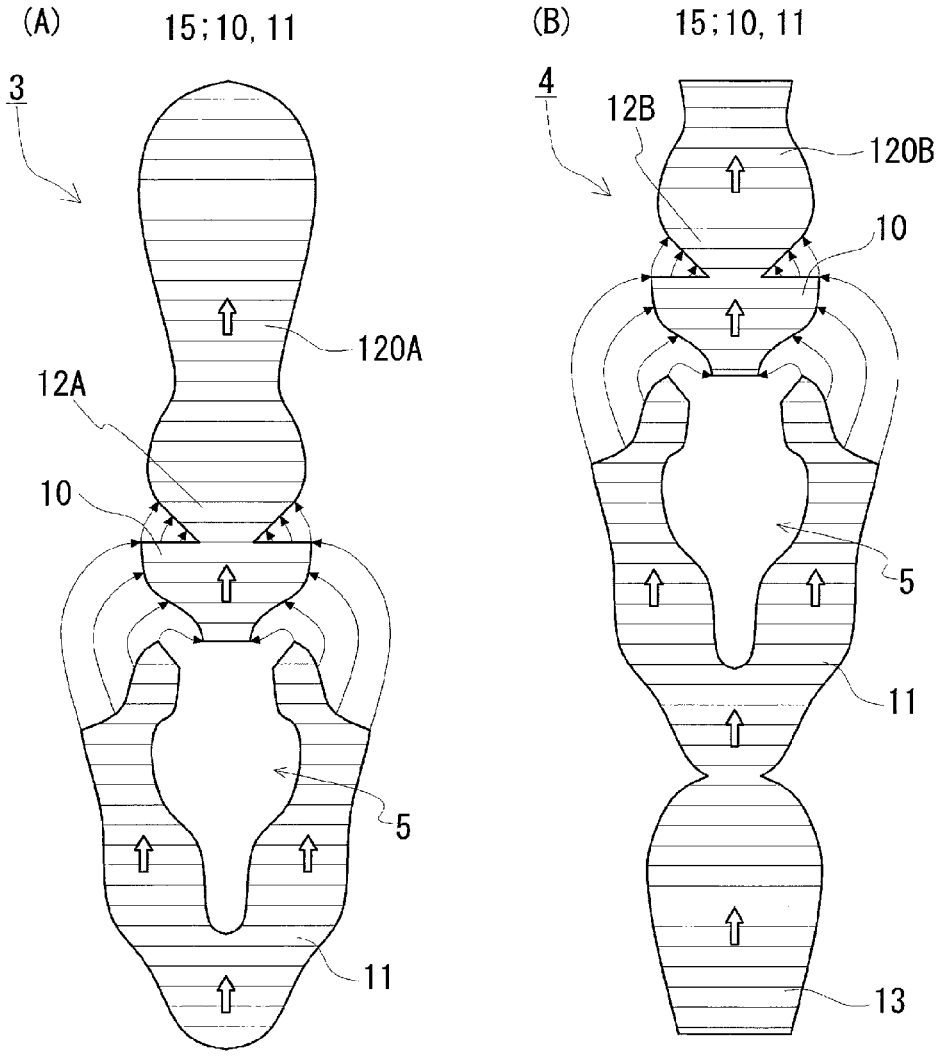
FIGS. 7(A) and 7(B) are schematic views showing a knitting procedure of an instep cover shown in a third embodiment.

In a third embodiment, instep covers 3, 4 in which the configuration of the shape retaining section differs from the second embodiment will be described based on FIG. 7. FIG. 7 is a schematic view showing the knitting procedure of the instep covers 3, 4.

In FIG. 7(A), a shape retaining section 12A is formed through the procedure similar to the second embodiment, and then a sole side knitted fabric 120A is knitted in continuation to the wale direction of the shape retaining section 12A to complete the instep cover 3. The sole side knitted fabric 120A has a shape corresponding to the sole of the wearer, and becomes an alternate of the sole cover.

In FIG. 7(B), a distal end section 13 is knitted, and thereafter, the body section 11, the heel cover section 10, a shape retaining section 12B, and a sole side knitted fabric 120B are knitted in such order to complete the instep cover 4. The distal end section 13, the shape retaining section 12B, and the sole side knitted fabric 120B are combined to function as the sole cover. An end in the knitting width direction on the body section 11 side in the distal end section 13 may be connected to the body section 11.

In addition, the shape of the distal end section 13 shown in FIG. 7(B) may be formed thin, so that the distal end section 13 becomes the tongue of the shoe when the distal end section 13 is folded back toward the body section 11 side. A configuration in which only the distal end section 13 is provided and the shape retaining section is not provided may be adopted. Members to become the sole cover, the tongue and the like may be freely combined to be provided on the toe side of the body section 11 or the heel cover section 10. Furthermore, the knitting yarn configuring each section may be the same or may be different.

The instep covers 3, 4 can be knitted in the direction opposite to the outlined arrow of FIGS. 7(A) and 7(B).

Fourth Embodiment

In a fourth embodiment, an instep cover 7 including a back side shape retaining section 22 and a front side shape retaining section 32 will be described based on FIG. 8 (see diagonally hatched portion of 45° for each section 22, 32). A method for knitting the instep cover 7 will be described based on FIG. 9.

<<Configuration of Instep Cover>>

The configuration of the heel cover section 10 and the body section 11 of the instep cover 7 is similar to the configurations of the first embodiment and the second embodiment, and hence the description thereof will be omitted. Hereinafter, the configurations of the back side shape retaining section 22 and the front side shape retaining section 32 will be mainly described. Only one of the back side shape retaining section 22 and the front side shape retaining section 32 may be arranged on the instep cover 7.

[Back Side Shape Retaining Section]

Figure 8:
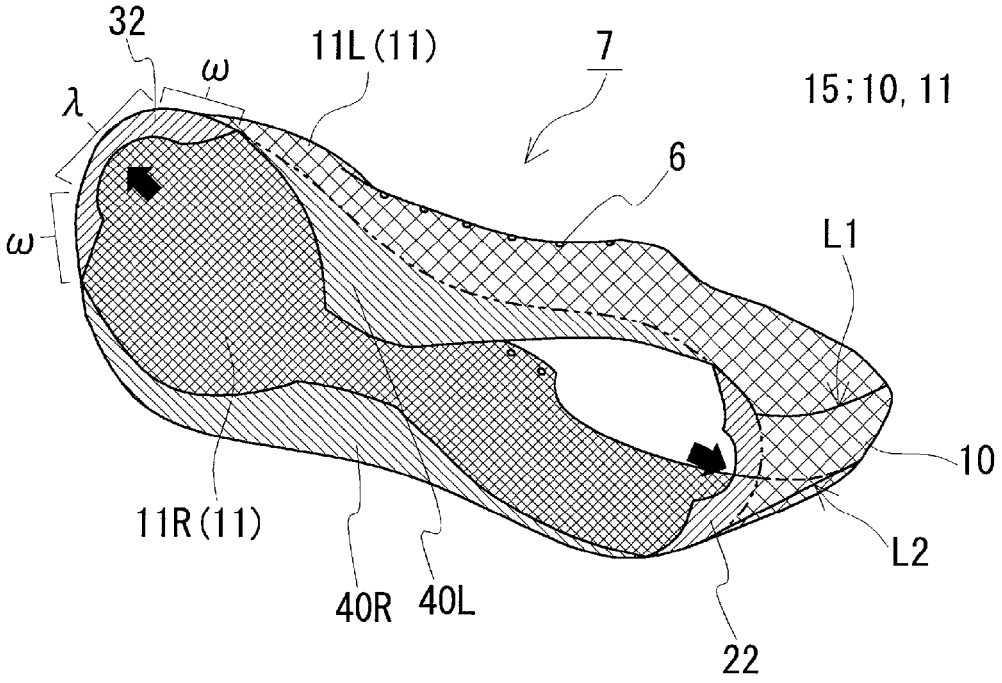
FIG. 8 is a schematic lower perspective view of an instep cover shown in a fourth embodiment.

As shown in FIG. 8, the back side shape retaining section 22 is a knitted fabric connected to the lower end side of the heel cover section 10 and the lower end side of the body section 11 at a position sandwiching the heel cover section 10, and folded toward the inward side of the opening on the lower end side of the cover main body 15, the back side shape retaining section 22 functioning to retain the portion on the heel side of the instep cover 7 in a three-dimensional shape lying along the roundness of the heel of the wearer. The contour of the connecting portion to the heel cover section 10 and the body section 11 in the back side shape retaining section 22 is curved to a hill shape.

The stitches at the end in the wale direction of the back side shape retaining section 22 are lined on the hill shaped contour. At the intermediate portion (portion indicated with chain double dashed line) of the contour, the stitch at the end in the wale direction of the heel cover section 10 and the stitch at the end in the wale direction of the back side shape retaining section 22 are continued, and the seam in appearance is not found between the sections 10 and 22. At both side edge portions (portion indicated with solid line) excluding the intermediate portion of the contour, the stitch at the end in the wale direction of the back side shape retaining section 22 and the end in the knitting width direction of the body section 11 (left side portion 11L and right side portion 11R) are connected through knitting, and a seam is found between the sections 11 and 22. With such connecting state, the left side portion 11L and the right side portion 11R connected to the back side shape retaining section 22 are moved in the direction of approaching each other, and the portion on the heel side of the cover main body 15 is formed to a rounded three-dimensional shape.

The stitches at the end in the wale direction on the side opposite to the contour are lined at the U-shaped portion indicated with a black arrow of the back side shape retaining section 22. In the present example, the knitting width of the U-shaped portion is narrower than the knitting width of the contour, and thus the left side portion 11L and the right side portion 11R are moved in the direction of approaching each other. As a result, the portion on the heel side of the cover main body 15 can be formed to a three-dimensional shape that further lies along the shape of the heel of the wearer. The size of the shoe upper 7 can be finely adjusted by adjusting the knitting width of the U-shaped portion and the knitting width of the contour. For example, the left side portion 11L and the right side portion 11R are further moved in the direction of approaching each other by making the knitting width of the U-shaped portion narrower than the illustrated state, and the size of the shoe upper 7 becomes smaller. That is, the shoe upper 7 of various sizes can be produced even if the size of the cover main body 15 is the same.

[Front Side Shape Retaining Section]

The front side shape retaining section 32 is a knitted fabric connected to the lower end side of the portion on the toe side of the body section 11, and folded toward the inward side of the opening on the lower end side of the cover main body 15, the front side shape retaining section 32 functioning to retain the portion on the toe side of the instep cover 7 in a three-dimensional shape lying along the roundness of the heel of the wearer. The contour of the connecting portion to the body section 11 in the front side shape retaining section 32 is formed to a hill shape.

The stitches at the end in the wale direction of the front side shape retaining section 32 are lined on the hill shaped contour. At the intermediate portion (portions indicated with λ) of the contour, the stitch at the end in the wale direction of the front side shape retaining section 32 and the stitch at the end in the wale direction of the body section 11 are continued, and the seam in appearance is not found between the body section 11 and the front side shape retaining section 32. At both side edge portions (portion indicated with ω) excluding the intermediate portion of the contour, the stitch at the end in the wale direction of the front side shape retaining section 32 and the stitch at the end in the knitting width direction of the body section 11 are connected through return knitting that forms a step difference, and a seam is found between the sections 11 and 32. With such connecting state, the left side portion 11L and the right side portion 11R connected to the front side shape retaining section 32 are moved in the direction of approaching each other, and the portion on the toe side of the cover main body 15 is formed to a rounded three-dimensional shape.

The stitches at the end in the wale direction on the side opposite to the contour are lined at the U-shaped portion indicated with a black arrow of the front side shape retaining section 32. The U-shaped portion functions similar to the U-shaped portion of the back side shape retaining section 32.

[Others]

Furthermore, the instep cover 7 of the present example includes bulging sections 40R, 40L that are formed on the side edge of the body section 11 and bulged out toward the sole side (see diagonally hatched portion of 135°). The bulging sections 40R, 40L facilitate the alignment and the connection of the instep cover 7 and the sole cover that is not shown. The bulging sections 40R, 40L are integrally knitted with the body section 11, as will be described later, and thus a seam is not found at the boundary of the body section 11 and the bulging sections 40R, 40L indicated with a chain double dashed line but a folding line is formed on the boundary when the instep cover 7 is fitted to the last and subjected to thermal processing.

<<Knitting Method I of Instep Cover>>

Figure 9:
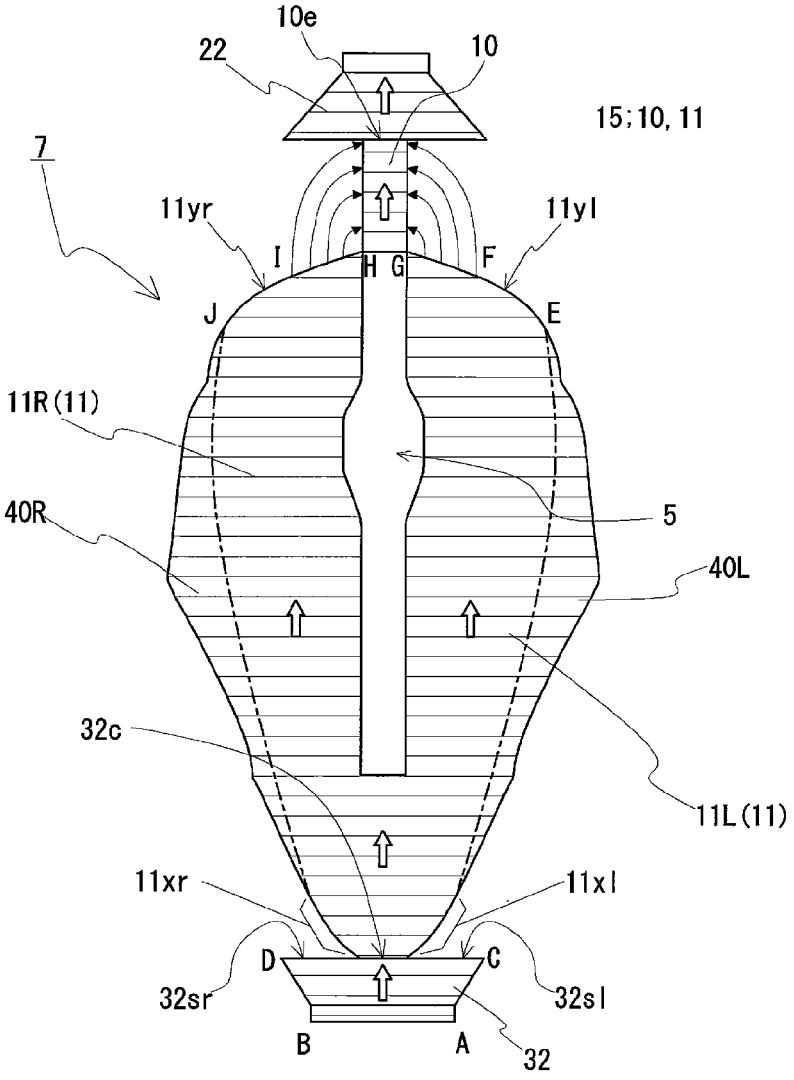
FIG. 9 is a schematic view showing a knitting procedure of the instep cover shown in the fourth embodiment.
Figure 10:
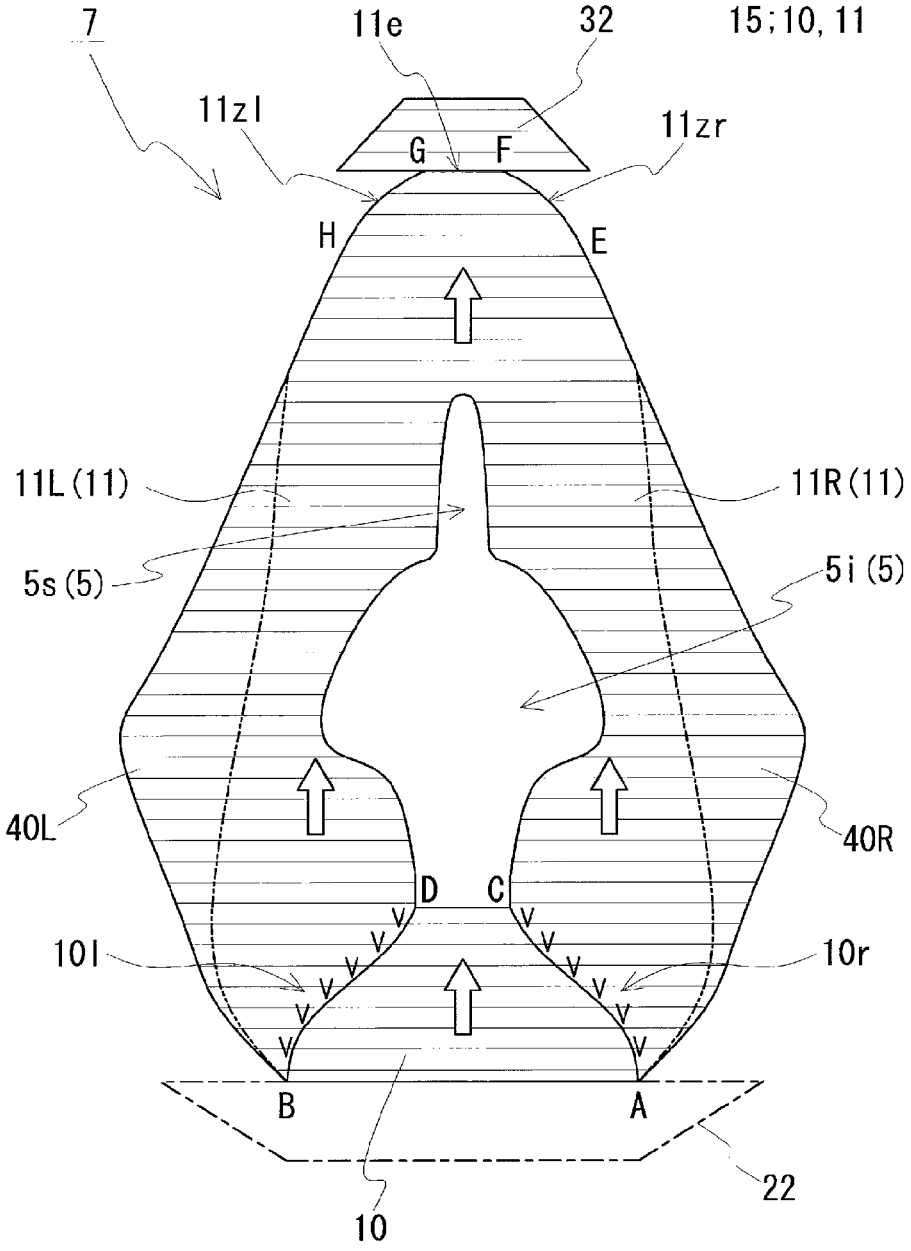
FIG. 10 is a schematic view showing another knitting procedure of the instep cover shown in the fourth embodiment.

The instep cover 7 can be knitted according to the knitting procedure shown in FIG. 9. In FIG. 9, the knitting is carried out from the toe side toward the heel side of the body section 11.

In the instep cover 7 of the present embodiment, the set up portion (see point A-point B) is first knitted through tubular knitting and the like, and such tubular knitting is carried out for a plurality of rows following the set up portion to gradually increase the knitting width and complete the front side shape retaining section 32 (corresponding to process α'). The terminating end in the wale direction (point C-point D) of the front side shape retaining section 32 is held on the needle beds. The front side shape retaining section 32 is preferably knitted thick using the front and back needle beds as shown in FIG. 3. The tubular knitting is a process of knitting the knitted fabric to a tubular shape using the front and back needle beds. The tubular knitting may not necessarily be carried out.

The body section 11 is then knitted (corresponding to process α). Specifically, the body section 11 is set up following a center stitch row 32*c* at the terminating end in the wale direction of the front side shape retaining section 32. When increasing the number of knitting courses of the body section 11, the stitches at the ends 11*xr*, 11*xl* in the knitting width direction of the body section 11 are formed in the side stitch rows 32*sr*, 32*sl* at the terminating end in the wale direction of the front side shape retaining section 32, and the side stitch rows 32*sr*, 32*sl* and the ends 11*xr*, 11*xl* in the knitting width direction are connected.

In the knitting of the body section 11 of the present example, the bulging sections 40R, 40L are knitted on both side edges of the body section 11. The bulging sections 40R, 40L enable a knitted fabric to be knitted with a width greater than the width desired for the body section 11 when increasing or reducing the knitting width of the body section 11. At the time point the knitting of the body section 11 is terminated, the stitches at the end in the knitting width direction of the left side portion 11L are lined on point E-point G, and the stitches at the end in the knitting width direction of the right side portion 11R are lined on point J-point H. Such stitches are also stitches at the end in the wale direction and are held on the needle beds.

The heel cover section 10 is then knitted assuming point G-point H as the set up portion, and such heel cover section 10 is connected to the body section 11 (corresponding to process β). The connecting method is already described in the first embodiment. The knitting structure of the cover main body 15 including the heel cover section 10 is not particularly limited.

Lastly, the back side shape retaining section 22 is knitted (corresponding to process γ'). Specifically, the back side shape retaining section 22 is set up in continuation to the terminating end 10*e* in the wale direction of the heel cover section 10, and the ends 11*yr*, 11*yl* in the knitting width direction of the body section 11 at the positions sandwiching the terminating end 10*e* in the wale direction. The knitting width of the back side shape retaining section 22 is then gradually narrowed, and lastly, the tubular knitting is knitted for a plurality of rows to complete the instep cover 7.

The three dimensional instep cover 7 shown in FIG. 8 can be knitted according to the procedure described above.

<<Knitting Method II of Instep Cover>>

The instep cover 7 can also be knitted from the heel side toward the toe side. The knitting method will be hereinafter described with reference to FIG. 10.

The knitting of the heel cover section 10 and the knitting procedure of the body section 11 are substantially similar to the knitting method II of the first embodiment that references FIG. 4. However, some stitches (see point E-point H) on the toe side of the body section 11 are left held on the needle beds. The stitches of point E-point F are stitches at the end 11*zr* in the knitting width direction of the right side portion 11R, and the stitches of point H-point G are stitches at the end 11*zl* in the knitting width direction of the left side portion 11L. Such stitches are also stitches at the end in the wale direction of the body section 11.

The front side shape retaining section 32 is then knitted (corresponding to process ξ'). Specifically, the front side shape retaining section 32 is set up in continuation to the terminating end 11*e* (see point F-point G) in the wale direction of the body section 11 and the ends 11*zr*, 11*zl* in the knitting width direction of the body section 11 at the positions sandwiching the terminating end 11*e* in the wale direction. The knitting width of the front side shape retaining section 32 is then gradually narrowed, and lastly the tubular knitting is knitted for a plurality of rows to complete the instep cover 7.

In addition, the back side shape retaining section 22 may be knitted (corresponding to process δ') before knitting the heel cover section 10 as shown with a chain dashed line. In this case, the heel cover section 10 is set up in continuation to the center stitch row at the terminating end in the wale direction of the back side shape retaining section 22 (corresponding to process δ). The heel cover section 10 is then completed, the body section 11 is set up following the edges 10*r*, 10*l* of the heel cover section 10 (corresponding to process ϵ), and thereafter, when increasing the number of knitting courses of the body section 11, the stitches at the end in the knitting width direction of the body section 11 are sequentially formed at the side stitch row excluding the center stitch row in the terminating end in the wale direction of the back side shape retaining section 22 (corresponding to process ξ).

DESCRIPTION OF SYMBOLS

1, 2, 3, 4, 7 instep cover
15 cover main body
10 heel cover section
10*e* end in wale direction
10*s* set up portion
10*l* edge on one end side
10*r* edge on the other end side
11 body section
11*e* terminating end in wale direction
11*xr*, 11*xl*, 11*yr*, 11*yl* end in knitting width direction
11*zr*, 11*zl* end in knitting width direction
11L left side portion
11R right side portion

12, 12A, 12B shape retaining section
120A, 120B sole side knitted fabric
13 distal end section
22 back side shape retaining section
32 front side shape retaining section
32*c* center stitch row
32*sr*, 32*sl* side stitch row
40R, 40L bulging section
L1, L2 boundary line
5 shoe opening
5*i* foot insertion opening
5*s* slit
6 eyelet hole
8, 9 yarn feeder

The invention claimed is:

1. An instep cover for a shoe upper, comprising a seamless knitted fabric knitted using a flat knitting machine including at least a pair of a front and a back needle bed, the instep cover covering a portion on an instep side of a wearer, wherein a portion of the instep cover that covers a region from an Achilles tendon to a heel of the wearer is a heel cover section, and a portion excluding the heel cover section is a body section;

a stitch in a vicinity of an end in a knitting width direction of the heel cover section and a stitch at an end in a wale direction of the body section are connected at a position of a boundary line of the heel cover section and the body section to form the instep cover three-dimensionally; and at least one part of the instep cover is configured with a knitting structure knitted using the front and back needle beds.

2. The instep cover according to claim 1, wherein the heel cover section has a shape in which a width gradually becomes narrower from a lower end side toward an upper end side of the instep cover.

3. The instep cover according to claim 1, further comprising a shape retaining section connected to at least one of a lower end on a toe side or a lower end on a heel side of a cover main body configured by the heel cover section and the body section, and bent toward an inward side of an opening on a lower end side of the cover main body to retain the cover main body in a three-dimensional shape lying along a shape of a foot of the wearer.

4. The instep cover according to claim 3, wherein the shape retaining section is a back side shape retaining section connected to the lower end of the heel cover section and the lower end of the body section at a position sandwiching the heel cover section, a contour of a connecting portion to the heel cover section and the body section in the back side shape retaining section being formed to a hill shape;

a stitch at an end in a wale direction of the back side shape retaining section is continued to an end in a wale direction of the heel cover section at an intermediate portion of the hill shaped contour; and a stitch at the end in the wale direction of the back side shape retaining section is connected to an end in the knitting width direction of the body section by knitting at both side edge portions excluding the intermediate portion in the hill shaped contour.

5. The instep cover according to claim 3, wherein the shape retaining section is a front side shape retaining section connected to a lower end of a portion on a toe side of the body section, a contour of a connecting portion to the body section in the front side shape retaining section being formed to a hill shape;

a stitch at an end in a wale direction of the front side shape retaining section is continued to an end in a wale direction of the body section at an intermediate portion of the hill shaped contour; and a stitch at the end in the wale direction of the front side shape retaining section is connected to the end in the knitting width direction of the body section by knitting at both side edge portions excluding the intermediate portion in the hill shaped contour.

6. A method for knitting an instep cover that covers a portion on an instep side of a wearer, of a shoe upper configuring a shoe, with a flat knitting machine including at least a pair of a front and a back needle bed; wherein a portion of the instep cover that covers a region from an Achilles tendon to a heel of the wearer is a heel cover section, and a portion excluding the heel cover section is a body section; wherein process α of knitting the body section from a toe side toward a heel side to complete the body section, a left side portion and a right side portion of the body section being knitted while being arranged side by side on the needle beds;

process β of knitting a set up portion to become an upper end of the heel cover section between a terminating stitch row of the left side portion and a terminating stitch row of the right side portion in a longitudinal direction of the needle bed; and process γ of repeating knitting of a stitch row to become the heel cover section following the wale direction of the set up portion and connecting of a stitch on one end side and a stitch on the other end side in a knitting width direction of the stitch row to a stitch of the terminating stitch row of the left side portion and a stitch of the terminating stitch row of the right side portion respectively to complete the heel cover section, are sequentially carried out; and a knitting structure is knitted using the front and back needle beds in at least one part of the process α to the process γ.

7. The method for knitting the instep cover according to claim 6, wherein at least one of process α' of knitting a front side shape retaining section, a knitted fabric in which a knitting width is gradually increased from a starting end toward a terminating end in a wale direction, for retaining a portion on the toe side of the instep cover in a three-dimensional shape lying along the roundness of the toe of the wearer before the process α, and process γ' of knitting a back side shape retaining section, a knitted fabric in which a knitting width is gradually narrowed from a starting end toward a terminating end in a wale direction, for retaining a portion on the heel side of the instep cover in a three-dimensional shape lying along the roundness of the heel of the wearer after the process γ, is carried out;

when carrying out the process α', in the process α, the body section is set up in continuation to a center stitch row at the terminating end in the wale direction of the front side shape retaining section, and a stitch at the end in the knitting width direction of the body section is formed on a side stitch row excluding the center stitch row at the terminating end in the wale direction of the front side shape retaining section when increasing the number of knitting courses of the body section; and when carrying out the process γ', in the process γ', the back side shape retaining section is set up in continuation to the terminating end in the wale direction of the heel cover section and the end in the knitting width direction of the body section at a position sandwiching the terminating end in the wale direction.

8. A method for knitting an instep cover that covers a portion on an instep side of a wearer, of a shoe upper configuring a shoe, with a flat knitting machine including at least a pair of a front and a back needle bed; wherein a portion of the instep cover that covers a region from an Achilles tendon to a heel of the wearer is a heel cover section, and a portion excluding the heel cover section is a body section; wherein process δ of knitting the heel cover section from a lower end side toward an upper end side while gradually narrowing a knitting width to complete the heel cover section;

process ϵ of setting up a left side portion of the body section following an edge on one end side in the knitting width direction of the heel cover section and setting up a right side portion of the body section following an edge on the other end side in the knitting width direction of the heel cover section; and process ξ of knitting the body section from the heel side toward the toe side to complete the body section, a left side portion and the right side portion of the body section being knitted while being arranged side by side on the needle beds, are sequentially carried out; and a knitting structure is knitted using the front and back needle beds in at least one part of the process δ to the process ξ.

9. The method for knitting the instep cover according to claim 8, wherein at least one of process δ' of knitting a back side shape retaining section, a knitted fabric in which a knitting width is gradually increased from a starting end toward a terminating end in a wale direction, for retaining a portion on the heel side of the instep cover in a three-dimensional shape lying along the roundness of the heel of the wearer before the process δ, and process ξ' of knitting a front side shape retaining section, a knitted fabric in which a knitting width is gradually narrowed from a starting end toward a terminating end in a wale direction, for retaining a portion on the toe side of the instep cover in a three-dimensional shape lying along the roundness of the toe of the wearer after the process ξ, is carried out;

when carrying out the process δ', in the process δ, the heel cover section is set up in continuation to a center stitch row at the terminating end in the wale direction of the back side shape retaining section, and in the process ξ, a stitch at the end in the knitting width direction of the body section is sequentially formed on a side stitch row excluding the center stitch row at the terminating end in the wale direction of the back side shape retaining section when increasing the number of knitting courses of the body section; and when carrying out the process ξ', the front side shape retaining section is set up in continuation to the terminating end in the wale direction of the body section and the end in the knitting width direction of the body section at a position sandwiching the terminating end in the wale direction.

* * * * *